US010388146B2

(12) United States Patent
Piccolo, III

(10) Patent No.: US 10,388,146 B2
(45) **Date of Patent: *Aug. 20, 2019**

(54) CONTEXTUAL FIRE DETECTION AND ALARM VERIFICATION METHOD AND SYSTEM

(71) Applicant: Tyco Fire & Security GmbH, Neuhausen am Rheinfall (CH)

(72) Inventor: Joseph Piccolo, III, Fitzwilliam, NH (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/805,223

(22) Filed: Nov. 7, 2017

(65) Prior Publication Data

US 2018/0061211 A1 Mar. 1, 2018

Related U.S. Application Data

(63) Continuation of application No. 14/860,286, filed on Sep. 21, 2015, now Pat. No. 9,824,574.

(51) Int. Cl.

| | |
|---|---|
| ***G08B 25/00*** | (2006.01) |
| ***G08B 29/18*** | (2006.01) |
| ***G08B 17/00*** | (2006.01) |

(52) U.S. Cl.

CPC ..... *G08B 25/001* (2013.01); *G08B 17/00* (2013.01); *G08B 29/18* (2013.01); *G08B 29/188* (2013.01)

(58) Field of Classification Search

CPC ..... G08B 17/00; G08B 25/001; G08B 19/00; G08B 29/00; G08B 29/18; G08B 29/181; G08B 29/185; G08B 29/20; G08B 29/24; G08B 29/26

See application file for complete search history.

(56) References Cited

U.S. PATENT DOCUMENTS

| | | | |
|---|---|---|---|
| 4,313,110 | A | 1/1982 | Subulak |
| 5,979,607 | A | 11/1999 | Allen |
| 6,078,269 | A | 6/2000 | Markwell et al. |
| 7,019,646 | B1 | 3/2006 | Woodard et al. |
| 9,013,294 | B1 | 4/2015 | Trundle |
| 2005/0057355 | A1 | 3/2005 | Barrieau et al. |
| 2008/0291036 | A1 | 11/2008 | Richmond |

(Continued)

OTHER PUBLICATIONS

European Search Report, dated Feb. 17, 2017, from European Application No. 16183712.5, filed Aug. 11, 2016. Eight pages.

*Primary Examiner* — Andrew W Bee

(74) *Attorney, Agent, or Firm* — HoustonHogle LLP

(57) ABSTRACT

A number of different approaches are described for minimizing or preventing false alarms. In one case, override panels are used such as locally near or in the protected space or remotely at a security desk, for example. These override panels are used to deactivate or block the generation of a fire alarm signal in the case where the occupants or a management personnel recognizes that the fire alarm signal should not be generated. In this way, an alarm verification step is included. In another aspect, additional, contextual information is used to characterize or adjust when fire alarm signals are generated. This contextual information can be generated from sources that are not typically used in the generation of the fire alarm signal but instead are based on other sources of the information concerning the protected space.

20 Claims, 5 Drawing Sheets

(56) References Cited

U.S. PATENT DOCUMENTS

| | | | |
|---|---|---|---|
| 2009/0212961 | A1 | 8/2009 | McGivern |
| 2012/0084857 | A1 | 4/2012 | Hubner et al. |
| 2014/0266699 | A1 | 9/2014 | Poder et al. |
| 2015/0022339 | A1 | 1/2015 | Matsuoka et al. |
| 2015/0170503 | A1 | 6/2015 | Wedig et al. |
| 2016/0021308 | A1 | 1/2016 | Kozko |
| 2016/0301373 | A1 | 10/2016 | Herman et al. |
| 2017/0084160 | A1 | 3/2017 | Piccolo, III |

122

FIG. 5

| Smoke Detector | Location | Increase Dependencies | Decrease Dependencies |
|---|---|---|---|
| Smoke detector 1 | kitchen | alarm sent when 5pm < current system time < 8am | |
| Smoke detector 2 | kitchen | kitchen motion detector active | kitchen motion detector inactive |
| Smoke detector 3 | kitchen | stove power monitor >= 2A | |
| | | | |
| heat detector 1 | kitchen | humidity level from humidity monitor > 80% | humidity level from humidity monitor < 20% |
| heat detector 2 | kitchen | video analytics system determines that people are present in kitchen | video analytics system determines that no people are present in kitchen |
| | | | |
| | | | |
| | | | |
| | | | |

140-1 140-2 140-3 140-4 140-5 140-6 140-7 140-8

82

```
// smoke detector 1
increaseFactor, decreaseFactor = 0;
if (increaseDependency1 OR increaseDependency2 OR increaseDependency3 == TRUE) then increaseFactor = (.5) defaultThreshold;
if (decreaseDependency1 OR decreaseDependency2 OR increaseDependency3 == TRUE) then decreaseFactor = (.5) defaultThreshold;
alarmThreshold = defaultThreshold + increaseFactor – decreaseFactor;
```

140-1 140-2 140-3 142-1 142-2 142-3

CONTEXTUAL FIRE DETECTION AND ALARM VERIFICATION METHOD AND SYSTEM

RELATED APPLICATIONS

This application is a Continuation of U.S. patent application Ser. No. 14/860,286, filed on Sep. 21, 2015, which is incorporated herein by reference in its entirety.

BACKGROUND OF THE INVENTION

Fire sensors such as smoke detectors and heat detectors are among the most effective devices for providing early warning of danger associated with fires. Nevertheless, because fire sensors typically provide highly reliable smoke detection at the earliest presence of fire, they are also susceptible to false alarms. Responding to false alarms wastes critical financial and equipment resources of emergency responders, places the safety of the emergency responders and that of citizens in the response path at risk, and can divert emergency responders away from actual emergencies.

False alarms are also costly to businesses. Businesses suffer productivity losses due to the downtime associated with false alarms. In addition, emergency responders such as fire departments are increasingly charging businesses for the cost associated with responding to false alarms.

Moreover, many individuals have become accustomed to false alarms. The nuisance associated with false alarms can cause individuals to ignore future fire alarms. As a result, adoption and use of fire sensors in settings such as residences and business premises is declining due to the high incidence of false alarms generated by smoke detectors in the premises.

Fire sensors are often wired to a building network system that includes a fire alarm control panel or monitoring system. When a fire sensor detects heat and/or smoke, the fire sensor sends an alarm signal indicative of fire, such as a smoke level or an alarm state, to the monitoring system. In response, the monitoring system issues a general fire alarm signal and contacts emergency responders via an emergency telephone network (e.g. 911), for example.

False alarms occur for a number of reasons. In one example, dirt and dust that has accumulated on or within the fire sensors can interfere with normal detector operation. This can occur in residential settings as well as in commercial or municipal settings. For example, dirt and dust caused from trains entering a train station can cause fire sensors installed on train platforms to register false alarms if the fire sensors are not regularly maintained. In another example, aging fire sensors that have not been replaced within the manufacturer's recommended replacement period (e.g. 10 years) can cause false alarms. In yet another example, the fire sensors are improperly situated near high humidity areas such as bathrooms, the high humidity of which can trigger false alarms.

In still another example of false alarms generated by fire sensors, a fire sensor installed in a kitchen area correctly detects a release of smoke from food items cooking in the kitchen area (e.g. bread in toaster, skillet on a stove). In many cases, an initial fire threat associated with food in a kitchen area detected by a fire sensor is a transitory threat that can usually be eliminated by an individual present in the kitchen. However, because the signal indicating the fire event has already been sent by the fire sensor to the monitoring system, the monitoring system issues the general fire alarm and contacts emergency responders to respond to the threat.

Traditional approaches to minimizing false alarms have typically focused on improving the capabilities of the fire sensors. Improvements to fire sensors include incorporating multiple sensors (e.g, optical, ionization) into the devices and by using advanced smoke detection algorithms. However, these improvements have not significantly reduced the number of false alarms.

SUMMARY OF THE INVENTION

Aspects of the present invention take a number of different approaches to minimizing or preventing false alarms. In one case, override panels are used, such as locally near or in the protected space or remotely at a security desk, for example. These override panels are used to deactivate or block the generation of a fire alarm signal in the case where the occupants or management personnel recognize that the fire alarm signal should not be generated. In this way, an alarm verification step is included. In another aspect, additional, contextual information is used to characterize or adjust when fire alarm signals are generated. This contextual information can be generated from sources that are not typically used in the generation of the fire alarm signal but instead are based on other sources of information concerning the protected space.

In general, according to one aspect, the invention features a fire detection system that comprises one or more fire sensors installed in a building for detecting indications of fire and generating alarm signals and one or more override panels that enable occupants of the building to generate override commands. A monitoring system generates a fire alarm in response to the alarm signals from the fire sensors and whether or not the override commands have been generated.

In embodiments, the override panels include an override panel located in a room of the building within which the fire sensors sending the alarm signals are also installed. Then, in response to the alarm signals from the fire sensors, the monitoring system generates a local alarm, and the monitoring system blocks generation of the fire alarm and clears the local alarm in response to receiving the override commands from the override panel prior to expiration of a local override delay.

Preferably, in response to information indicative of the presence or absence of occupants, the monitoring system determines whether to generate the local alarm, the generation of which is a precondition for the monitoring system generating the fire alarm. Motion detectors, for example, can generate the information indicative of the presence or absence of occupants. Alternatively, or in addition, one or more surveillance cameras can capture video data within the building and an image analytics system can then analyze the video data captured by the one or more surveillance cameras to generate the information indicative of the presence or absence of occupants.

The override panels can also include a security desk override panel located in a security office of the building, wherein in response to the alarm signals from the fire sensors, the monitoring system generates a local alarm and generates the fire alarm if the local alarm is not acknowledged at the security office prior to expiration of the acknowledgment delay.

In general, according to another aspect, the invention features a fire detection method that includes detecting indications of fire and generating alarm signals and enabling occupants of the building to generate override commands. Then, a fire alarm is generated if the override commands have been not been issued.

In general, according to another aspect, the invention features a fire detection system that includes one or more fire sensors for detecting indications of fire and generating alarm signals and one or more non-fire detecting devices for detecting contextual information with respect to the one or more fire sensors. A monitoring system then generates a fire alarm in response to the alarm signals from the fire sensors and the contextual information from the non-fire detecting devices.

The fire sensors can include heat detectors and smoke detectors, for example. In one implementation, the monitoring system creates dependencies from the contextual information from the non-fire detecting sensors and uses the dependencies to minimize generating false fire alarms.

In examples, the non-fire detecting devices include at least one surveillance camera for monitoring an environment of at least one of the fire sensors, and the system further includes an image analytics system for determining presence and/or absence of individuals in the environment of the at least one of the fire sensors; wherein the monitoring system uses the determined presence and/or absence of individuals in the environment of the at least one of the fire sensors as the contextual information for determining whether to generate the fire alarm in response to the alarm signals from the at least one of the fire sensors.

The non-fire detecting devices can also include at least one motion sensor that detects motion within an environment of at least one of the fire sensors; wherein the monitoring system uses the detected motion in the environment of the at least one of the fire sensors as the contextual information for determining whether to generate the fire alarm in response to the alarm signals from the at least one of the fire sensors.

Further, the non-fire detecting devices can include at least one power monitor that detects power consumption of electrical devices, e.g., appliances, located within an environment of at least one of the fire sensors; wherein the monitoring system uses the detected power consumption of the electrical devices in the environment of the at least one of the fire sensors as the contextual information for determining whether to generate the fire alarm in response to the alarm signals from the at least one of the fire sensors.

Further, the non-fire detecting devices can include at least one temperature monitor that detects ambient temperature levels of an environment of at least one of the fire sensors, wherein the monitoring system uses the ambient temperature levels in the environment of the at least one of the fire sensors as the contextual information for determining whether to generate the fire alarm in response to the alarm signals from the at least one of the fire sensors.

Further, the non-fire detecting devices can include at least one humidity monitor that detects humidity levels of an environment of at least one of the fire sensors, wherein the monitoring system uses the humidity levels in the environment of the at least one of the fire sensors as the contextual information for determining whether to generate the fire alarm in response to the alarm signals from the at least one of the fire sensors.

Still further, the non-fire detecting devices can include at least one manual pull station that sends a signal indicating activation of the manual pull station within an environment of at least one of the fire sensors, wherein the monitoring system uses the signal indicating activation of the manual pull station in the environment of the at least one of the fire sensors as the contextual information for determining whether to generate the fire alarm in response to the alarm signals from the at least one of the fire sensors.

In general, according to another aspect, the invention features a fire detection method that includes detecting indications of fire and generating alarm signals, detecting contextual information for one or more fire sensors from non-fire detecting devices, and generating a fire alarm in response to alarm signals from the fire sensors and the contextual information from the non-fire detecting devices.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings:

FIG. 5 shows a table of dependencies that the event context system creates from the contextual information received from the one or more non-fire sensor devices, and also shows pseudocode of an exemplary software action that references the dependencies, and where the event context system executes the exemplary software action for determining whether to generate the fire alarm in response to the alarm signals sent from the fire sensors.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
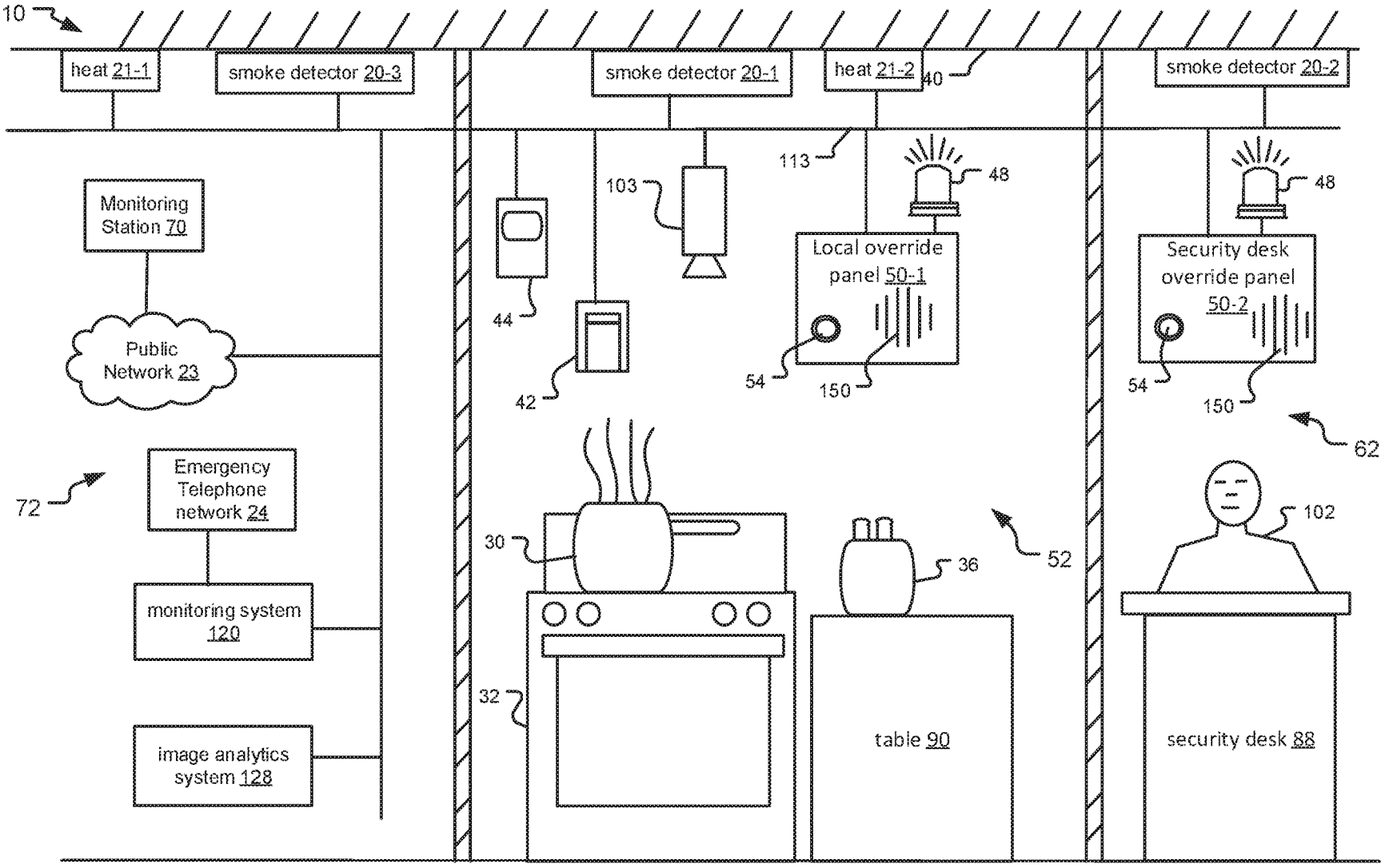
FIG. 1 is a system block diagram showing a first embodiment of a fire detection and alarm system including fire sensors installed in an exemplary premises such as a residential or commercial building, where the system also includes override panels.

FIG. 1 shows a first embodiment of a fire detection and alarm system 10 including fire sensors installed in a premises such as a residential or commercial building, where the system also includes override panels according to the principles of the present invention.

Shown are a set of rooms 52, 62, 72 in a residential building. In one example, the building is an apartment building. In other examples, however, the system 10 is deployed in nonresidential buildings, such as office buildings that may have a kitchen or appliances in a breakroom, for example.

The first room 72 corresponds to a utility closet that includes parts of the system including the monitoring system. Also, access to a public network 23 is provided through networking devices potentially including routers or hubs.

Also shown is a second room 52 that potentially corresponds to a kitchen or breakroom within the building. As is common, this room may include a stove 32 and other electrical appliances such as a toaster 36 on the table 90.

Finally, in another room 62, a security desk 88 for possibly an apartment or commercial building is provided. Security personnel 102 may man this security desk 88.

In each of these rooms 72, 52, 62 fire sensors such as heat detectors 21-1, 21-2 and smoke detectors 20-1, 20-2, 20-3 are installed. In addition, the residential room 52 may further include such other security, safety devices such as a motion detector 44, a fire pull station 42, and a surveillance camera 103.

In the illustrated example, the components of the fire detection and alarm system are located within the utility closet or utility room 72. This includes a monitoring system 120 such as a monitoring panel. It communicates with an emergency telephone network 24 so that it can automatically call the fire department in the case of a fire. Also, in the illustrated example, an image analytics system 128 is further provided. In different examples, this image analytics system 128 stores video from the surveillance camera 103. It also preferably analyzes that video to determine whether rooms within the building are occupied, for example.

According to an aspect of the invention, occupants of the building can use the override panels 50-1, 50-2 to override a fire alarm. The occupants generate override signals via the override panels 50-1, 50-2 when the users know or have reason to know that a fire alarm instigated by fire sensors is false or transient and benign (e.g. a mere puff of smoke from a toaster).

In one example of its operation, the heat detector 21-2 in kitchen area 52 detects heat from a pot boiling 30 on a stove 32. In response, the heat detector 21-2 or the smoke detector 20-1 send(s) alarm signal(s) indicative of fire to the monitoring system 120, which activates a local alarm, in response. In one example, this local alarm is an audible signal that is generated by speaker 150 of the local override panel 50-1, which is installed in the same room 52 from where the alarm signals originated. This local alarm need only be audible to the occupants in the kitchen 52 rather than the entire building.

As a result, a person in the kitchen hearing the local alarm will realize that it is due to the transitory heat condition caused by the boiling pot 30 and that there is no need for the generation of a building-wide fire alarm or a call to the fire department. In response, the person selects/depresses the override button 54 of the override panel 50-1 or otherwise signals the panel 50-1 such as by a voice recognition system in the kitchen area 52. The monitoring system 120 receives the override signal sent by the local override panel 50-1, and in response, clears the local alarm and blocks the triggering of the fire alarm by the monitoring system 120.

In this way, a false alarm, the evacuation of the building, and potentially the issuing of a fire alarm signal to the local fire department are avoided.

In another implementation, the receipt of fire alarm signals from the smoke detector 20-1 or the heat detector 21-1 in room 52 or the detection of heat by the heat detector 21-1 or the smoke detector 20-3 in room 72 lead to the generation of a local alarm by the security desk override panel 50-2. This allows the security personnel 102 at the security desk 88, for example, to investigate the possibility of a fire in rooms 52 or 72, for example, due to normal activities such as the boiling pot 30 or the toaster 36. Here again, in the case of the detection of an indication of fire in the utility closet 72 or the kitchen 52, a local alarm is generated at the security desk override panel 50-2 such as an audible alarm by its speaker 150.

The generation of this local alarm allows the security personnel 102 to investigate the source of the alarm and then issue an override signal to the monitoring system 120 to avoid a false alarm, when appropriate.

Figure 2:
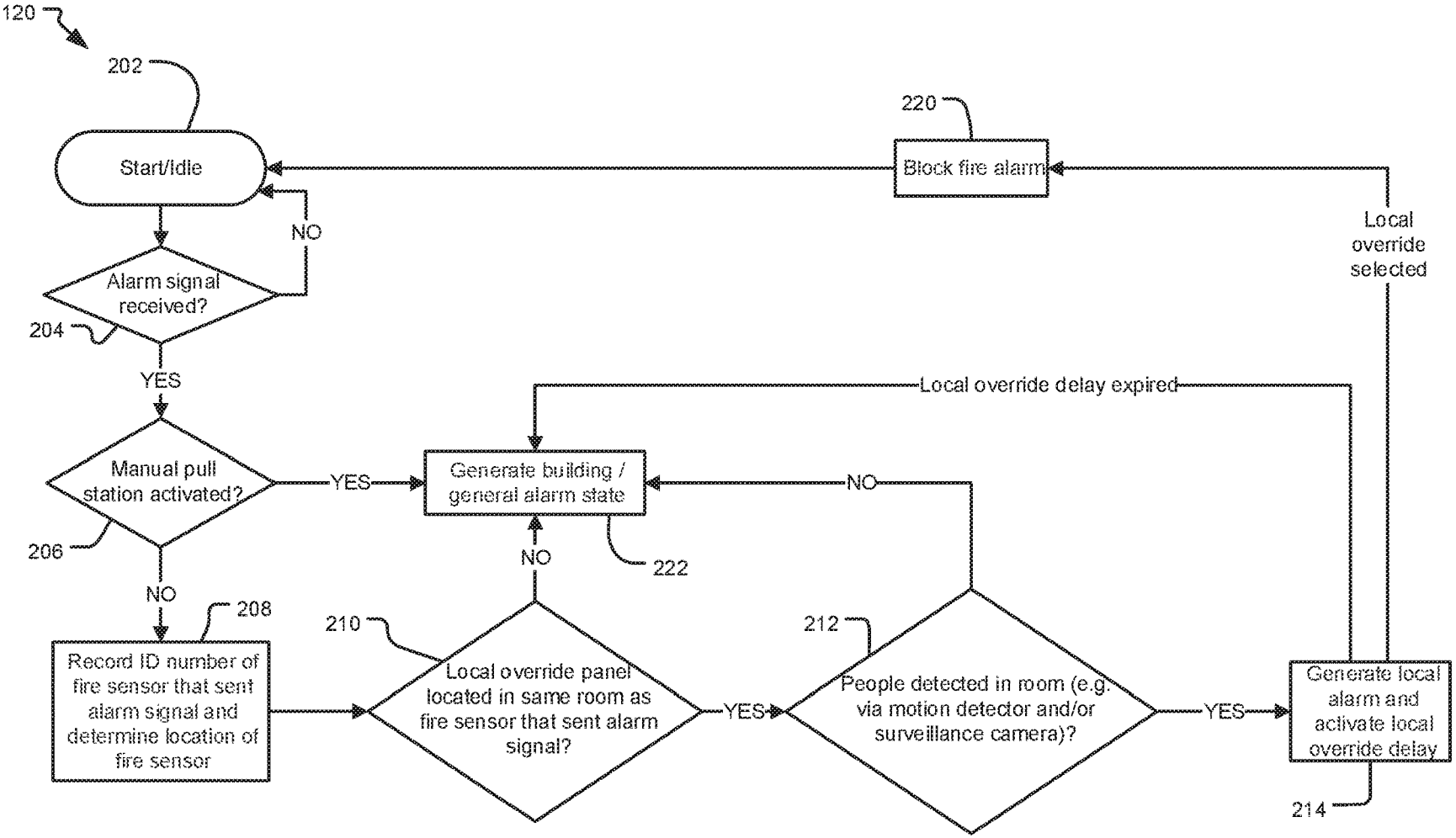
FIG. 2 is a flow diagram that shows a method of operation of the monitoring system for handling override signals from local override panels.

FIG. 2 is a flow diagram that shows a method of operation of the monitoring system 120 for handling override signals from local override panels.

This shows how the monitoring system 120 determines whether to generate a fire alarm when the monitoring system 120 receives alarm signals sent by fire sensors 20-1, 20-2, 20-3, 21-1, and/or 21-2 and/or information sent from non-fire detecting devices (e.g. motion detectors 44, or surveillance cameras 103) and override signals sent from override panels 50-1, 50-2, when the fire sensors, the non-fire detecting devices, and the override panel are located within the same room of a building (e.g. the kitchen) as the source of the alarm signals.

In more detail, in step 202, the fire detection system is in its normal idle state, and remains in the state until an alarm signal is received in step 204. This alarm signal would typically be generated by any one of the fire sensors 20-1, 20-2, 20-3, 21-1, and/or 21-2, in the illustrated example.

In step 206, the fire detection system determines whether or not a manual pull station such as pull station 42 has been activated. In general, the activation of a manual pull station is determined by the system to be strong evidence of a potential fire and as a result the flow proceeds to the generation of a building or general alarm state in step 222.

On the other hand, if a manual pull station has not been activated, the ID number of the activated fire sensor is sent to the monitoring system 120 to determine the location of the fire sensor. Specifically, the proximity between the override panel and the activated fire sensor is assessed. If a local override panel is not located in the same room as the room in which the activated fire sensor is located or also potentially a nearby room, then again, general building alarm state is initiated in step 222.

On the other hand, if there is an available local override panel 50-1, 50-2 such as in the same room or a nearby room or in the same apartment or on the same floor as the activated fire sensor, then in step 212, the system optionally determines whether or not people are detected in the room and/or a nearby room and/or in the same apartment and/or on the same floor as the activated fire sensor. If people are not determined to be in the same room as or otherwise nearby the override panel, then it does not make sense to wait for the activation of the override signal since no one is in proximity to activate the override panel 50-1, 50-2. Thus, in this case, the fire alarm is generated.

On the other hand, if it is determined that people are in proximity to the override panel 50-1, then the local alarm is generated in step 214 and a local override delay is performed. The justification is that if there is a local override panel 50-1, 50-2 local to the source of the alarm signals, and people are further present, then they should be notified that the fire detection system is in the process of potentially generating a fire alarm by generating the local alarm. The local alarm thus gives them an opportunity to override the generation of fire alarm.

From step 214, processing takes one of two paths. If the local override is selected, such as by a user pressing override button 54 such as on the local override panel 50-1, then the fire alarm is blocked in step 220. On the other hand, if the override is not selected within the local override delay, which can be as short as a 10 seconds or as long as several minutes, then the general alarm state for the building is activated in step 222.

Figure 3:
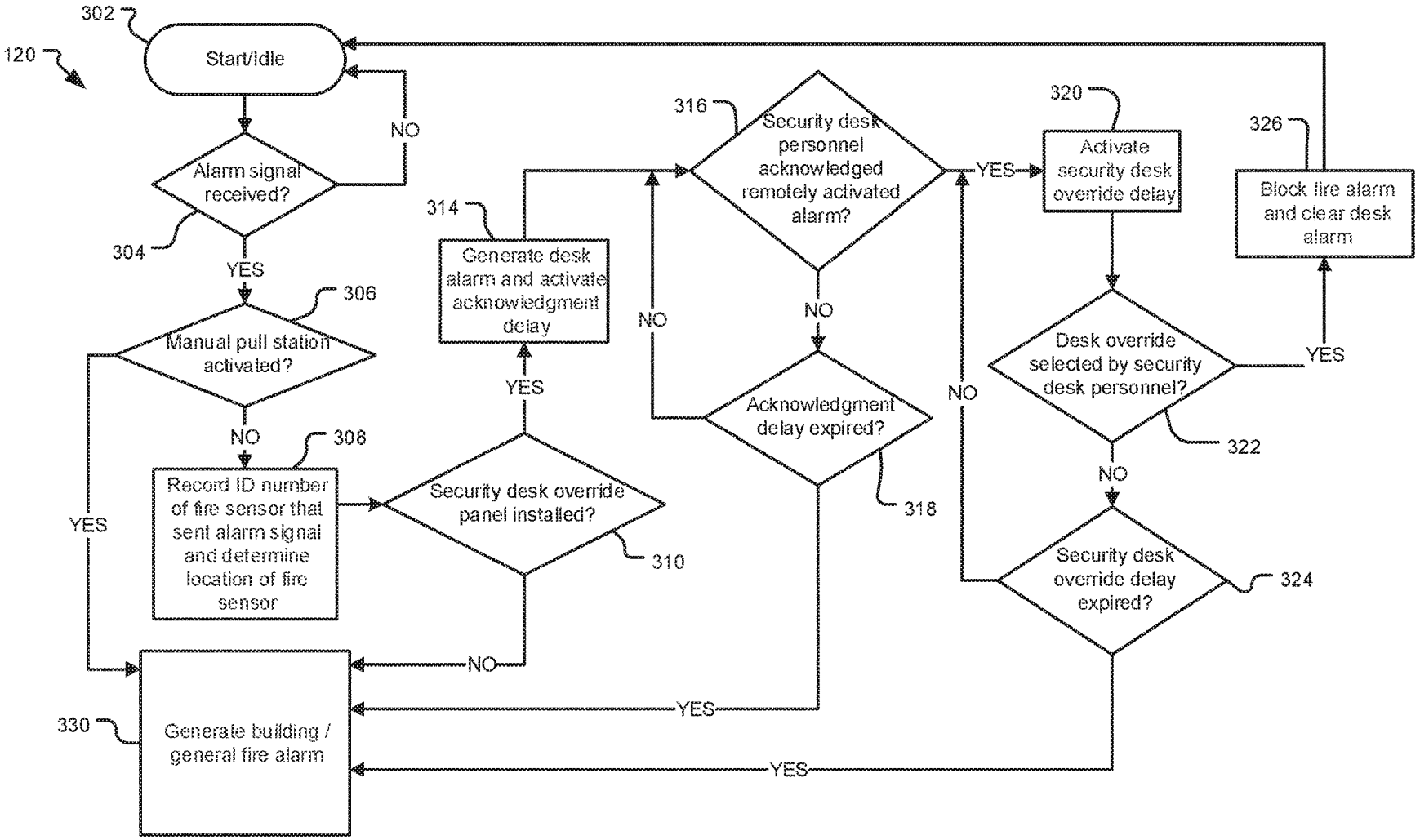
FIG. 3 is a flow diagram that shows a method of operation of the monitoring system for handling override signals from security desk override panels.

FIG. 3 is a flow diagram that shows a method of operation of the monitoring system 120 for handling override signals from security desk override panels 50-2.

This shows how the monitoring system 120 determines whether to generate the fire alarm when the override panel 50-2 is installed in a different room than the fire sensors that generated the alarm signals and the non-fire detecting devices. In the example, a desk override panel 50-2 is installed in a security office 62 that generates the override signals.

In steps 302 and 304, the fire detection and alarm system 10 waits for the receipt of fire alarm signals such as from one of the fire sensors 20-1, 20-2, 20-3, 21-1, and/or 21-2.

If the fire alarm signals originate from a manual pull station as determined in step 306, then the fire alarm is not blocked and a general building fire alarm is generated in step 330.

On the other hand, if the fire alarm signal is not from a manual pull station then the record ID of the fire sensor sending the alarm signals is sent to the monitoring system 120 and its location is determined in step 308. It is then determined if a security override panel is installed in step 310 and whether the sensor sending the alarm signals is subject to security desk override. If so, then a local desk alarm is generated in step 314 at the security desk override panel 50-2 and a local acknowledgment delay process is started in step 314.

The process then circulates between steps 316 and 318. Specifically, the monitoring system 120 in step 316 checks whether or not the security desk personnel have acknowledged the local alarm, which is generated by, for example, an audible signal from speaker 150 of the override panel 50-2. The audible signal may further include a synthetically generated verbal description of the location of the alarm signals.

On the other hand, the monitoring system determines whether or not the security desk personnel have taken too long to acknowledge the local alarm in step 318. If the security desk personnel do not acknowledge the local alarm, in for example 20 seconds to a minute by depressing the button 54 on the panel 50-2 or by verbally acknowledging the local alarm in the case of a voice recognition system, then the general fire alarm is generated in step 330. On the other hand, if within the delay, the security desk personnel do acknowledge the local alarm as determined in step 316, then a second override delay is started in step 320. Specifically, this delay allows the security personnel to investigate the location that was the source of the alarm signals to determine whether or not a fire is actually present.

A dead man's switch-type delay is now initiated. That is, if the security desk override delay expires as determined in step 324, then the general building fire alarm is generated in step 330. This addresses the situation where the security personnel investigate the fire and learn that a fire is actually present and then become consumed with putting out the fire or assisting others, for example. In another situation, the security desk personnel could become overwhelmed by the fire. In such situations, then a fire alarm will be generated in step 330 at the expiration of the override delay as determined in step 324.

On the other hand, if within the override delay, which can be as short as tens of seconds to as long as several minutes, the override signal is generated by the security personnel such as by depressing switch 54 on the security desk override panel 50-2, then the fire alarm is blocked in step 326. This addresses the situation where the security personnel investigate the location of the fire and discover that no fire is present. Then, they generate the override signal from the security desk override panel 50-2, for example, or potentially some other override panel within the building to thereby block the generation of the fire alarm in step 326.

Figure 4:
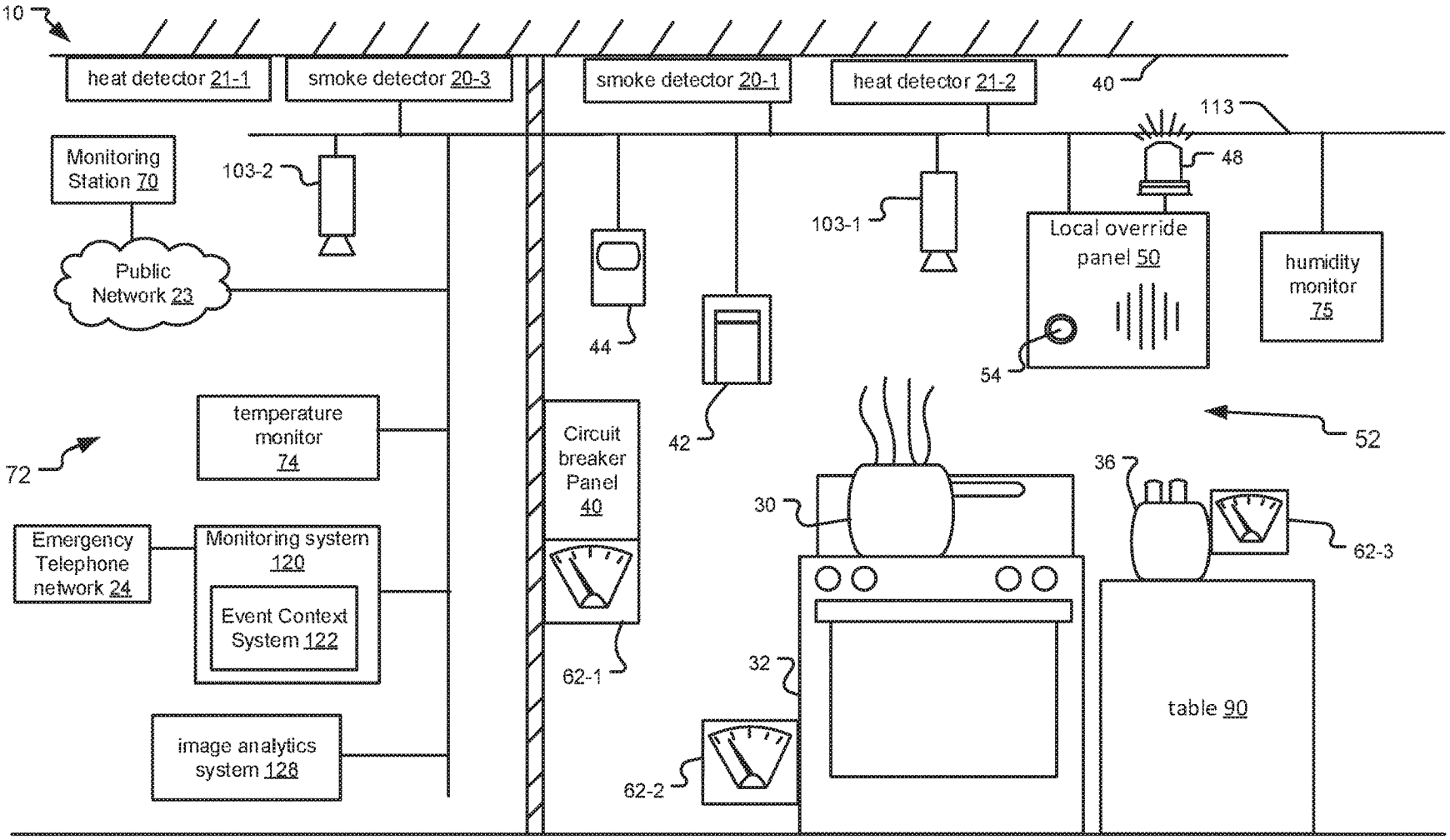
FIG. 4 is a system block diagram showing a second embodiment of a fire detection system with an event context system.

FIG. 4 is a system block diagram showing a second embodiment of a fire detection system with an event context system.

In this embodiment, the event context system 122 of the monitoring system 120 receives alarm signals in response to detected fire conditions from the fire sensors 20-1, 20-3, 21-1, and/or 21-2 and contextual information from one or more non-fire sensor devices. The non-fire detecting devices include surveillance cameras 103-1, 103-2, motion detectors 44, and manual pull stations 42. In addition, the non-fire detecting devices in this embodiment include temperature monitors 74, humidity monitors 75, and power monitors 62-1, 62-2, in examples.

The non-fire sensors 42, 44, 62-1, 62-2, 62-3, 74, 75, 103-1, 103-2 send contextual information associated with the environment of the fire sensors 20-1, 20-3, 21-1, and/or 21-2. In one example, the environment of the fire sensors includes a wiring closet 72 and a nearby room 52 within which the fire sensors are installed, where the fire sensors can detect conditions indicative of fire in both the wiring closet 72 and the nearby room 52. In the same example, the contextual information is the determined presence or absence of individuals in the room 52 and in the wiring closet 72.

In more detail, the wiring closet 72 in this example includes a temperature monitor 74 and potentially a surveillance camera 103-2. Each of these non-fire detecting devices generates context information that is detected by the monitoring system 120.

In a similar vein, other rooms within the building such as kitchen 52 further include additional non-fire detecting devices for generating context information for the monitoring system 120. For example, the motion detector 44 detects motion such as people moving within the room 52. The surveillance camera 103-1 captures images from the room which can then be analyzed by the image analytics system 128 or an analytics system incorporated within the camera. Further, a humidity monitor 75 monitors humidity within the room 52.

In the illustrated example, power monitors 62-1, 62-2, 62-3 are further provided for circuit breaker panels 40 and or specific appliances 32, 36, respectively. For example, the stove 32 has a power monitor 62-2. Further, the toaster 36 has its own power monitor 62-3. In addition or alternatively, a power monitor 62-1 is provided for the circuit breaker panel 40 that controls the electricity to the room 52.

Each of these power monitors provides power consumption information back to the monitoring system 120. Specifically, in the illustrated embodiment, the event context system 122 analyzes the contextual information provided by these non-fire detecting devices to determine whether or not a fire alarm signal should be generated.

FIG. 5 shows a table of dependencies that the event context system 122 applies to the contextual information received from the one or more non-fire sensor devices, and also shows pseudocode of an exemplary software action that references the dependencies, and where the event context system executes the exemplary software action for determining whether to generate the fire alarm in response to the alarm signal sent from the fire sensors.

This shows one implementation of the event context system for determining whether to generate the fire alarm in response to the alarm signal sent from the fire sensors 20-1, 20-2, 20-3, 21-1, and/or 21-2. In the implementation the monitoring system 120 generates a fire alarm when an alarm threshold is reached for any one of the fire sensors 20-1, 20-2, 20-3, 21-1, and/or 21-2. However, the sensitivity, specifically the alarm threshold, is adjusted based on the contextual information received from the non-fire detecting devices 42, 44, 62-1, 62-2, 62-3, 74, 75, 103-1, 103-2.

In the example, the event context system adjusts the alarm threshold by creating dependencies from the contextual information, where the dependencies are associated with states of the non-fire detecting devices and aspects of contextual information they provide, in examples. The event context system then references the dependencies in software actions to determine whether to generate the fire alarm in response to the alarm signals sent from the fire sensors.

In the exemplary software action, the alarm threshold is initially initialized to a default threshold. However, the software action uses conditional logic that references the dependencies and the default threshold to adjust the alarm threshold. The alarm threshold can be adjusted in either an increasing manner (e.g. less likely to trigger a fire alarm) or in a decreasing manner (e.g. more likely to trigger a fire alarm) using the dependencies created from the contextual information.

In more detail, in the illustrated embodiment, the event context system 122 maintains dependencies that have the effect of changing the alarm threshold for the associated fire sensor based on context information from non-fire detecting devices. For example, for smoke detector 1 20-3, an increase dependency 140-1 concerns whether current system time of the alarm signal is between 5 PM and 8 AM. Such dependency would be created based on the assumption that during those periods of time people would be present and activate a pull box station if a fire were actually present.

In another example, smoke detector 2 20-1 increases its threshold (becomes less sensitive to fire) if the kitchen motion detector 44 is active due to increase dependency 140-2. Here the assumption is that if people are in the kitchen they might be cooking and therefore generating smoke. Thus, the smoke detectors threshold should be increased. On the other hand, smoke detector 2 has a decrease dependency 140-4 which makes it more sensitive when the motion detector 44 in the kitchen 52 is inactive (people are not present in the kitchen).

Smoke detector 3 has an increase dependency 140-3 that decreases its sensitivity making it less likely to generate an alarm if the stove power monitor 62-2 registers that the stove is drawing power, i.e., turned on, and drawing greater than 2 Amp. Here, the logic is that if the stove is working, the generated smoke could be from cooking, and therefore the smoke detector 20-1 should become less sensitive.

In the case of heat detector 1 21-2, its sensitivity decreases 140-5 and specifically its temperature alarm threshold increases when the humidity monitor 75 detects an ambient humidity of greater than 80%. In effect, the threshold for an alarm is increased, making the heat detector 1 21-1 less sensitive during high humidity levels. On the other hand, if the humidity level is very low than a decrease dependency 140-6 is provided.

Heat detector 2 21-2 includes an increase dependency 140-7 that increases its alarm threshold when the video analytics system 128 determines that people are present based on the video data from surveillance camera 103-1. The logic here is that if people are present in the kitchen then the heat generated may be from their bodies or from their cooking and not be indicative of fire. Therefore the threshold for generating a fire alarm should be increased. On the other hand, if the video analytics system 128 determines that no people are present in the kitchen 52 then the threshold for fire is decreased by a decrease dependency 140-8.

The pseudocode listing 82 illustrates how potentially multiple increase dependencies and decrease dependencies are combined by the event context system 122 to adjust the alarm thresholds applied by the monitoring system 120 for each of the separate fire sensors.

For example, for smoke detector 1, if any one of potentially three increase dependencies are true, then the alarm threshold for the device is increased by 50%, thus making the device less sensitive and the monitoring system less likely to generate an alarm. At the same time if any one of three or more decrease dependencies are determined to be true then the alarm threshold is decreased by 50%, in the illustrated embodiment. The final alarm threshold is then determined by combining the default alarm threshold with any increaseFactor or decreaseFactor determined by the analysis of the increase and decrease dependencies. In this way, the system uses context information from non-fire detecting devices to change when fire alarms are generated.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire detection system, the system comprising:

one or more fire sensors installed in a building for detecting indications of fire and generating alarm signals;

one or more override panels that enable occupants of the building to generate override commands; and a monitoring system for generating a fire alarm in response to the alarm signals from the one or more fire sensors and whether or not the override commands have been generated;

wherein the monitoring system determines if one of the override panels is located in a same room as an activated one of the fire sensors and directly generates the fire alarm when no override panel is located in the same room as the activated fire sensor.

2. The system of claim 1, wherein in response to the one or more alarm signals from the one or more fire sensors, the monitoring system generates a local alarm, and wherein the monitoring system blocks generation of the fire alarm and clears the local alarm in response to receiving the override commands from the one or more override panels prior to expiration of a local override delay.

3. The system of claim 1, further comprising manual pull stations that send signals indicating activation of the manual pull stations by the occupants, the activation of which causes the monitoring system to generate the fire alarm.

4. A fire detection method, the method comprising:

detecting indications of fire with fire sensors and generating alarm signals;

enabling occupants of a building to generate override commands at one or more override panels;

a monitoring system determining if one of the override panels is located in a same room as an activated one of the fire sensors;

the monitoring system directly generating the fire alarm when no override panel is located in the same room as the activated fire sensor; and generating a fire alarm based on the indications from the fire sensors if the override commands have not been issued.

5. The method of claim 4, further comprising generating a local alarm and blocking generation of the fire alarm in response to receiving the override commands from an override panel prior to expiration of a local override delay.

6. The method of claim 4, further comprising determining a presence or absence of occupants, and determining whether to generate a local alarm, the generation of which is a precondition for a monitoring system generating the fire alarm.

7. The method of claim 4, further comprising determining a presence or absence of occupants with motion detectors.

8. The method of claim 4, further comprising determining a presence or absence of occupants with one or more surveillance cameras that capture video data within the building and an image analytics system that analyzes the video data captured by the one or more surveillance cameras and generates the information indicative of the presence or absence of occupants.

9. A fire detection system, the system comprising:

one or more fire sensors for detecting indications of fire and generating alarm signals;

one or more non-fire detecting devices for detecting contextual information concerning a presence of individuals for the one or more fire sensors; and a monitoring system for generating a fire alarm in response to the alarm signals from the one or more fire sensors and the contextual information from the one or more non-fire detecting devices;

wherein the monitoring system creates dependencies from the contextual information from the one or more non-fire detecting sensors and uses the dependencies to minimize generating false fire alarms by changing alarm thresholds for the fire sensors.

10. The system of claim 9, wherein the one or more fire sensors include heat detectors and smoke detectors.

11. The system of claim 9, wherein the one or more non-fire detecting devices include at least one temperature monitor that detects ambient temperature levels of an environment of at least one of the fire sensors; wherein the monitoring system uses the ambient temperature levels in the environment of the at least one of the one or more fire sensors as the contextual information for determining whether to generate the fire alarm in response to the alarm signals from the at least one of the one or more fire sensors.

12. The system of claim 9, wherein the one or more non-fire detecting devices include at least one humidity monitor that detects humidity levels of an environment of at least one of the fire sensors; wherein the monitoring system uses the humidity levels in the environment of the at least one of the one or more fire sensors as the contextual information for determining whether to generate the fire alarm in response to the alarm signals from the at least one of the one or more fire sensors.

13. The system of claim 9, wherein the one or more non-fire detecting devices include at least one manual pull station that sends a signal indicating activation of the manual pull station within an environment of at least one of the fire sensors; wherein the monitoring system uses the signal indicating activation of the manual pull station in the environment of the at least one of the one or more fire sensors as the contextual information for determining whether to generate the fire alarm in response to the alarm signals from the at least one of the one or more fire sensors.

14. A fire detection method, the method comprising:

detecting indications of fire and generating alarm signals from one or more fire sensors;

detecting contextual information for the one or more fire sensors from non-fire detecting devices;

a monitoring system generating a fire alarm in response to the alarm signals from the fire sensors and the contextual information from the non-fire detecting devices;

determining the presence and/or absence of individuals in the environment of the at least one of the one or more fire sensors; and using the determined presence and/or absence of individuals in the environment of the at least one of the one or more fire sensors as the contextual information for determining whether to generate the fire alarm in response to the alarm signals from the at least one of the one or more fire sensors.

15. The method of claim 14, wherein the fire sensors include heat detectors and/or smoke detectors.

16. The method of claim 14, wherein the presence and/or absence of individuals in the environment of the at least one of the one or more fire sensors is determined using motion sensors.

17. The method of claim 14, further comprising:

detecting ambient temperature of an environment of at least one of the one or more fire sensors; and using the ambient temperature levels in the environment of the at least one of the one or more fire sensors as the contextual information for determining whether to generate the fire alarm in response to the alarm signals from the at least one of the one or more fire sensors.

18. The method of claim 14, further comprising:

detecting humidity levels of an environment of at least one of the one or more fire sensors; and using the humidity levels in the environment of the at least one of the one or more fire sensors as the contextual information for determining whether to generate the fire alarm in response to the alarm signals from the at least one of the one or more fire sensors.

19. The method of claim 14, further comprising:

determining activation of a manual pull station within an environment of at least one of the one or more fire sensors; and using the signal indicating activation of the manual pull station in the environment of the at least one of the one or more fire sensors as the contextual information for determining whether to generate the fire alarm in response to the alarm signals from the at least one of the one or more fire sensors.

20. A fire detection method, the method comprising:

detecting indications of fire with one or more fire sensors;

detecting contextual information from non-fire detecting devices concerning the presence of individuals;

a monitoring system using dependencies between the detected indications of fire and the contextual information to adjust thresholds for generating fire alarms.

* * * * *